US007369789B2

(12) United States Patent
Lee et al.

(10) Patent No.: US 7,369,789 B2
(45) Date of Patent: May 6, 2008

(54) DOOR STATUS SWITCH OPERATION MECHANISM FOR IMAGE FORMING APPARATUS

(75) Inventors: Sang-Woon Lee, Seoul (KR); Heung-Sup Jeong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 172 days.

(21) Appl. No.: 11/234,271

(22) Filed: Sep. 26, 2005

(65) Prior Publication Data

US 2006/0120746 A1 Jun. 8, 2006

(30) Foreign Application Priority Data

Dec. 7, 2004 (KR) ..... 10-2004-0102219

(51) Int. Cl.
*G03G 15/00* (2006.01)
*G03G 21/00* (2006.01)

(52) U.S. Cl. ..... 399/90; 399/107; 399/124

(58) Field of Classification Search ..... 399/88, 399/90, 107, 124, 411
See application file for complete search history.

(56) References Cited

U.S. PATENT DOCUMENTS 6,647,223 B2 * 11/2003 Ishii ..... 399/90

FOREIGN PATENT DOCUMENTS

| | | |
|---|---|---|
| JP | 07-064463 | 3/1995 |
| JP | 2004-074527 | 3/2004 |
| KR | U1993-0004609 | 5/1992 |
| KR | 1999-0024341 | 12/1997 |
| KR | 2000-0006492 | 4/2000 |
| KR | 2000-0010058 | 6/2000 |

* cited by examiner

*Primary Examiner*—Hoang Ngo
(74) *Attorney, Agent, or Firm*—Roylance, Abrams, Berdo & Goodman, LLP

(57) ABSTRACT

There is provided an image forming apparatus including a case having a first door and a second door. An image forming unit is arranged inside the case and a switch which supplies or suspends electricity to the image forming unit. The first door includes a pusher to press the switch. When the first door and the second door are closed, the second door presses the pusher, which in turn presses the switch to supply electricity to the image forming unit.

15 Claims, 5 Drawing Sheets

DOOR STATUS SWITCH OPERATION MECHANISM FOR IMAGE FORMING APPARATUS

CROSS-REFERENCE TO RELATED APPLICATIONS

This application claims the benefit under 35 U.S.C. 119(a) of Korean Patent Application No. 10-2004-0102219, filed on Dec. 7, 2004, the entire disclosure of which is hereby incorporated by reference.

BACKGROUND OF THE INVENTION

1. Field of the Invention

The present invention relates to an image forming apparatus. More particularly, the present invention relates to an image forming apparatus having a switch to supply or suspend electricity to an image forming unit in accordance with the opening or closing of a door.

2. Description of the Related Art

Generally, an image forming apparatus such as a printer or copier includes a case used as an outer covering. An image forming unit is disposed inside the case for printing an image on a sheet of paper. The case has one or more doors for replacing or repairing components such as a light scanner or a developer that are included in the image forming unit. Additionally paper jams may be removed.

The image forming apparatus does not operate while the door is open. Therefore, the image forming apparatus comprises means for suspending electricity supply when the door is open. The means generally includes a microswitch.

However, conventionally, one microswitch is needed for each door, so that an image forming apparatus with a plurality of doors such as a color printer requires many microswitches. This adds to the complexity and cost of the image forming apparatus.

Accordingly, there is a need for an improved image forming apparatus for managing the supply of electricity to the unit.

SUMMARY OF THE INVENTION

An aspect of the present invention is to solve at least the above problems and/or disadvantages and to provide at least the advantages described below. Accordingly, an aspect of the present invention is to provide an image forming apparatus capable of supplying and suspending electricity to an image forming unit using a single switch for a plurality of doors.

According to an aspect of the present invention, there is provided an image forming apparatus comprising a case including a first door and a second door. An image forming unit is disposed inside the case and a switch supplies or suspends electricity to the image forming unit. The first door includes a pusher for pressing the switch when the first door and the second door are closed. The second door presses the pusher, which in turn presses the switch to supply electricity to the image forming unit.

The switch is preferably a microswitch. When the lever of the microswitch is pressed by the pusher, electricity to the image forming unit is supplied. When the lever of the microswitch is not pressed by the pusher, the lever is released and electricity to the image forming apparatus is suspended.

The pusher may be hinged to the end of the first door. Preferably, the pusher is an L-shaped element including a projection for pressing the switch.

The pusher may be sprung away from the switch.

The image forming apparatus further comprises a first door locking means to prevent the first door from being opened when the second door is closed.

The first door locking means may include a locking projection formed on the second door, and a locking groove formed on the second door to mate with the locking projection.

Other objects, advantages, and salient features of the invention will become apparent to those skilled in the art from the following detailed description, which, taken in conjunction with the annexed drawings, discloses preferred embodiments of the invention.

BRIEF DESCRIPTION OF THE DRAWINGS

The above and other objects, features, and advantages of certain embodiments of the present invention will be more apparent from the following description taken in conjunction with the accompanying drawings, in which:

FIGS. 2 and 3 are sectional views illustrating doors of the image forming apparatus shown in FIG. 1 and a microswitch to supply and suspend electricity to an image forming unit in accordance with opening or closing of the doors, in which FIG. 2 illustrates a second door closed and a first door open and FIG. 3 illustrates the first and second doors closed; and FIGS. 4 and 5 are sectional views illustrating a first door locking means of the image forming apparatus shown in FIG. 1 in which FIG. 4 illustrates the first door closed and the second door open, and FIG. 5 illustrates the first and second doors closed.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for conciseness.

Figure 1:
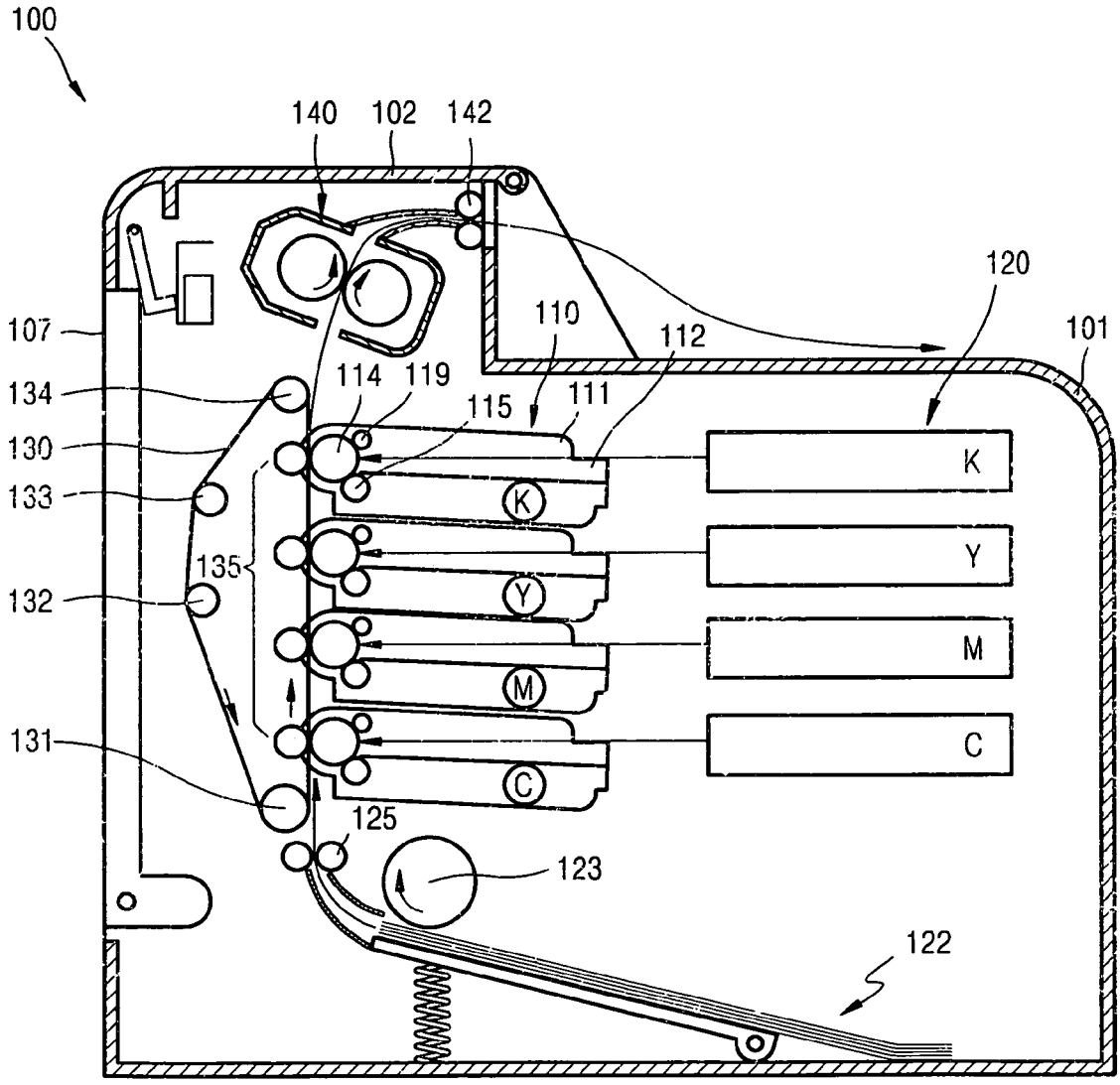
FIG. 1 is a sectional view illustrating an image forming apparatus in accordance with an embodiment of the present invention.

Referring to FIG. 1, the image forming apparatus 100 is an electrophotographic color printer for printing a color image on a sheet of paper. The electrophotographic color printer scans light onto a photosensitive medium charged with an electric potential to form an electrostatic latent image. The electrophotographic color printer develops the electrostatic latent image with a developing agent, such as toner, into a visual image, transfers the image onto the sheet of paper, and fuses the image to the sheet of paper. The image forming apparatus 100 comprises four developers 110, four light scanners 120, a transfer belt 130, four transfer rollers 135, and a fuser 140, which are included in an image forming unit in the case 101. The image forming apparatus 100 also comprises a cassette 122 for containing paper, a pick-up roller 123 for picking up the paper from the cassette 122, feed rollers 125 for conveying the paper, and eject rollers 142 for discharging the paper out of the case 101 after printing.

Figure 2:
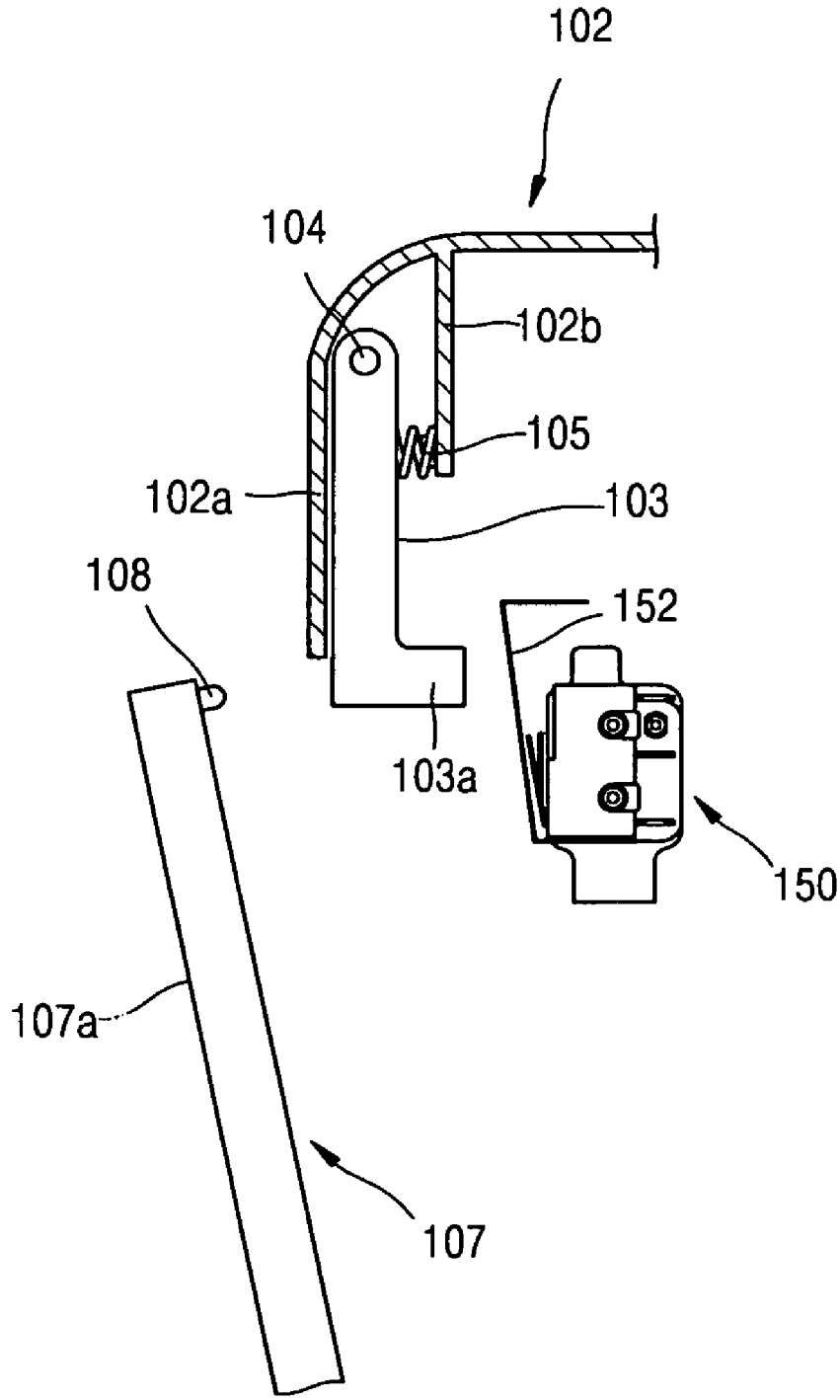

The developer 110 is a single cartridge. The developer 110 includes four developers 110C, 110M, 110Y, 110K, which contain four different toners, such as cyan C, magenta M, yellow Y, and black K as shown in FIG. 2. A first door 102 and a second door 107 are respectively formed on the top and the left side of the case 101. When the second door 107 is opened, a pulley 134 for supporting the transfer belt 130 is pulled with the first door 102, the transfer belt 130 moves horizontally and a path is formed for inserting and detaching the developers 110C, 110M, 110Y, 110K. Therefore, the developers 110C, 110M, 110Y, 110K may be replenished with new toner through this path when toners in the developers 110C, 110M, 110Y, 110K are consumed.

The transfer belt 130 is rotatably supported by a plurality of pulleys 131 to 134, and circulates in a horizontal direction. In the present embodiment, the four light scanners 120 correspond respectively to the four developers 110C, 110M, 110Y, 110K. The light scanners 120C, 120M, 120Y, 120K scan light corresponding to cyan, magenta, yellow, and black image information onto a photosensitive medium 114 mounted on housings 111 of the four developers 110C, 110M, 110Y, 110K. A laser scanning unit (LSU) that uses laser diode as light source may be used in one of the light scanners 120C, 120M, 120Y, 120K.

The developers 110C, 110M, 110Y, 110K comprise a photosensitive medium 114 and developing rollers 115. A part of the outer surface of the photosensitive medium 114, which faces the transfer belt 130 when the image is formed, is exposed outside the housings 111. Thus, the image may be transferred onto the paper. The developers 110C, 110M, 110Y, 110K comprise charge rollers 119. The charge rollers 119 are given a charge bias for electrically charging the outer surface of the photosensitive medium 114. The developing rollers 115 supply the toner attached to their outer surface to the photosensitive medium 114. The developing rollers 115 are given a developing bias for applying toner to the photosensitive medium 114.

Although not shown, the housings 111 of the developers 110C, 110M, 110Y, 110K each include a toner feed roller that supplies the toner to the developing rollers 115. A doctor blade regulates the amount of toner attached to the developing rollers 115. An agitator, in the form of a conveyor belt, supplies the toner to the toner feed roller. In the present embodiment, the developers 110C, 110M, 110Y, 110K include openings 112 to allow light from the light scanners 120C, 120M, 120Y, 120K to pass through and onto the photosensitive medium 114.

The four transfer rollers 135 and the photosensitive medium 114 face one another and the transfer belt 130 is located therebetween. The four transfer rollers 135 are given a transfer bias.

The process of forming a color image using the image forming apparatus 100 will now be described.

The charge rollers 119 are used to uniformly charge the photosensitive medium 114 of the developers 110C, 110M, 110Y, 110K. The light scanners 120C, 120M, 120Y, 120K produce light corresponding to cyan, magenta, yellow, and black image information, respectively. The light is applied to the charged photosensitive medium 114 through the openings 112. Thus, an electrostatic latent image is formed on the outer surface of the photosensitive medium 114 of the developers 110C, 110M, 110Y, 110K. The developing rollers 115 are given a developing bias. The toner on the developing rollers 115 is transferred to the outer surface of the photosensitive medium 114. In this way, cyan, magenta, yellow, and black images are formed on the outer surface of the photosensitive medium 114 of the developers 110C, 110M, 110Y, 110K.

The pick-up roller 123 picks up the paper from the cassette 122. The feed rollers 125 feed the paper to the transfer belt 130. The paper is attached to the surface of the transfer belt 130 by an electrostatic force. Consequently, the paper may be conveyed by the transfer belt 130 with minimal movement.

The leading edge of the paper is conveyed to a transfer nip between the transfer rollers 135 and the photosensitive medium 114. The leading edge of the cyan image on the outer surface of the photosensitive medium 114 also arrives at the nip about the same time. When the transfer bias is applied to the transfer rollers 135, the cyan, magenta, yellow, and black images of the photosensitive medium 114 are transferred in sequence onto the paper. This transfer forms the color image on the paper. The fuser 140 applies heat and pressure to the color image on the paper to securely fix the color image to the paper. The paper is discharged from the case 101 by the eject rollers 142.

The first door 102 of the image forming apparatus 100 may be used to remove a jammed sheet of paper from the fuser 140 or to replace or repair the fuser 140. The second door 102 of the image forming apparatus 100 may also be used to remove a jammed sheet of paper from between the developers 110 and the transfer belt 130. Moreover, the second door may also be used to replace or repair the transfer belt 130, the developers 110, or the light scanners 120.

The image forming apparatus cannot operate correctly while the doors 102 and 107 are open. Therefore, the image forming apparatus 100 comprises means for suspending electricity supply when the doors 102 and 107 are open.

Figure 3:
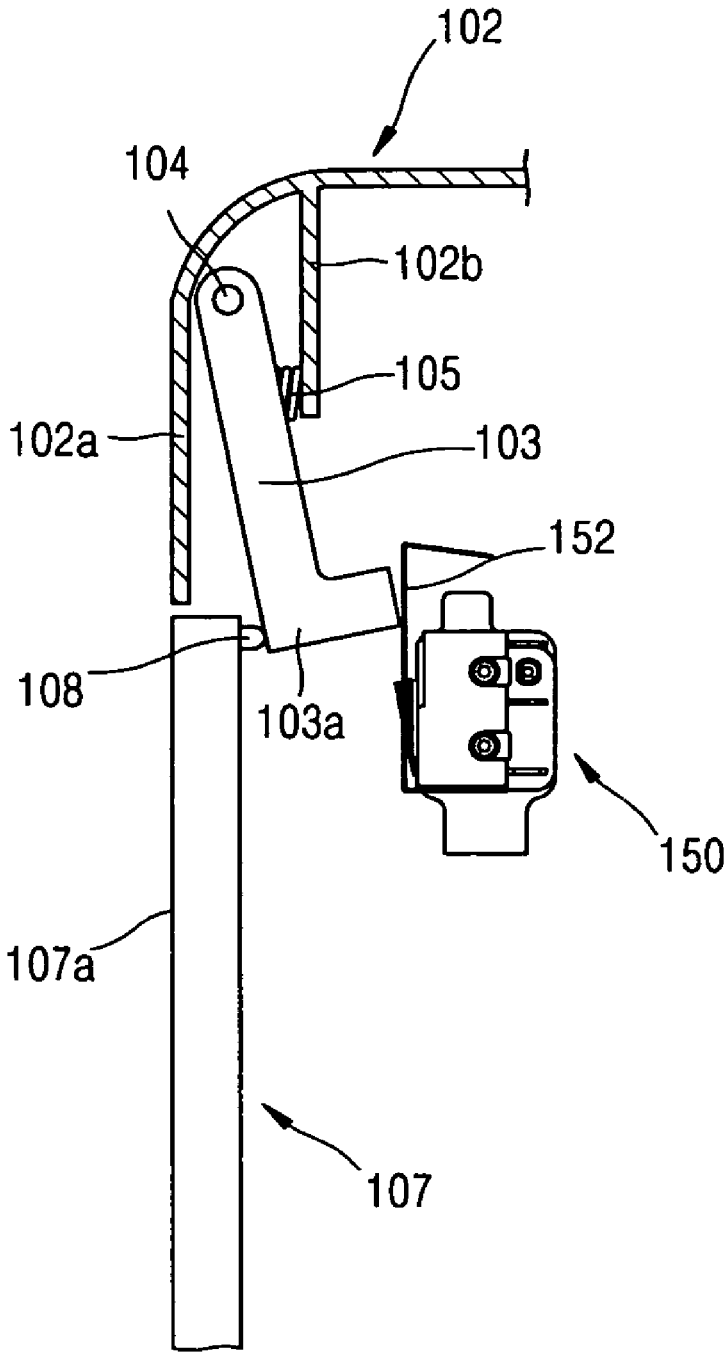

Referring to FIGS. 2 and 3, the means for suspending electricity to the image forming unit comprises a microswitch 150 included in the case 101, a pusher 103 formed on the first door 102 to press the microswitch 150, and a projection 108 formed on the second door 107 to press the pusher 103.

The microswitch 150 is a small switch similar to a reset switch or keyboard switch of a computer. When a lever 152 of the microswitch 150 is pressed, an inner contact of the microswitch 150 is touched and electricity is supplied to the image forming unit. When the lever 152 of the microswitch 150 is not pressed, a spring (not shown) disconnects the inner contact and electricity to the image forming unit is suspended.

The pusher 103 is preferably substantially L-shaped element connected to the end of the first door 102 using a hinge 104. The pusher includes a projection 103*a* for pressing the lever 152 of the microswitch 150. When the first door 102 is closed, the bottom of the pusher 103 projects lower than the bottom of a first door panel 102*a*. The pusher 103 is pressed by a spring 105 away from the microswitch 150 so that the lever 152 of the microswitch 150 is not pressed. The spring 105 is interposed between the pusher 103 and a first bracket 102*b* inside the first door panel 102*a* presses the pusher 103.

The projection 108 formed on the second door 107. The spring 105 projects inwards from the top of a second door panel 107*a*. Referring to FIG. 3, when the first door 102 and the second door 107 are both closed, the projection 108 internally presses the bottom of the pusher 103.

The image forming apparatus 100 includes first door locking means for preventing the first door 102 from being opened while the second door 107 is closed. If the pusher 103 of the first door 102 is pressing the lever 152 of the microswitch 150, opening the first door 102 before the second door 107 may damage the microswitch 150 and the pusher 103. Thus the first door locking means is preferably provided to prevent damage and malfunction.

Figure 4:
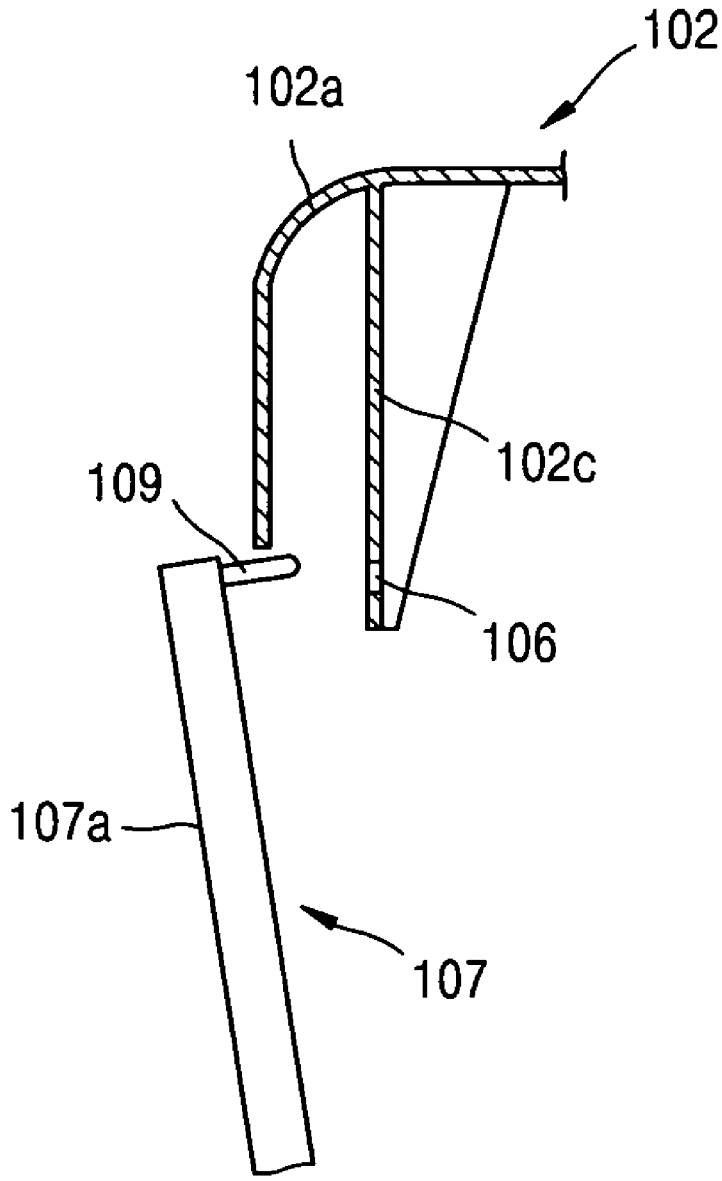
Figure 5:
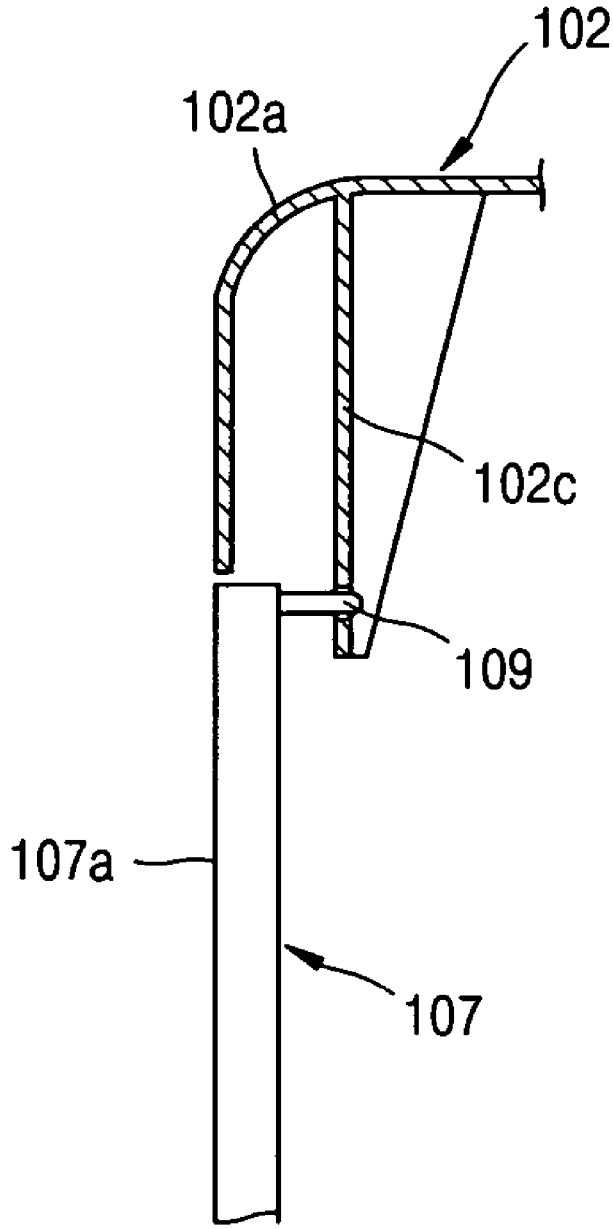

Referring to FIGS. 4 and 5, the first door locking means includes a locking projection 109 projecting inwards from the top of the second door panel 107*a*. A locking groove 106 is formed on a second bracket 102*c* inside the first door panel 102*a*. The first bracket 102*b* (see FIGS. 2 and 3) and the second bracket 102*c* of the first door 102 are formed on different sections and may be compatible with one another. Likewise, the pressure projection 108 (see FIGS. 2 and 3) and the locking projection 109 of the second door 107 may be compatible with one another.

Referring to FIGS. 2 through 5, the operation of the means for suspending electricity to the image forming unit will now be described. While the first door 102 and the second door 107 are closed, the projection 108 of the second door 107 presses inwards against the bottom of the pusher 103. In turn, a projection 103*a* of the pusher 103 presses the lever 152 of the microswitch 150 to maintain contact and supply electricity to the image forming unit as shown in FIG. 3.

However, as shown in FIG. 2, when the second door 107 is opened, the projection 108 separates from the pusher 103. The pusher 103 releases the lever 152 of the microswitch 150. Therefore, the inner contact of the microswitch 150 is broken and electricity to the image forming unit is suspended. Although not shown, when the first door 102 is opened, the pusher 103 separates from the microswitch 150 to also suspend electricity to the image forming unit.

While the first door 102 and the second door 107 are closed, the locking projection 109 of the second door 107 mates with the locking groove 106 of the first door 102, as shown in FIG. 5. The second bracket 102*c* of the first door 102 is held by the locking projection 109, and the first door 102 cannot be lifted. However, referring to FIG. 4, when the second door 107 is opened, the locking projection 109 is removed from the locking groove 106 and the first door 102 is unlocked.

The image forming apparatus of the present invention can supply and suspend electricity to the image forming unit using a single switch, thereby reducing the cost and complexity of the image forming apparatus.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An image forming apparatus comprising:

a case including a first door and a second door;

an image forming unit arranged inside the case; and a switch to supply or suspend electricity to the image forming unit; and first door locking means to prevent the first door from being opened when the second door is closed;

wherein the first door includes a pusher to press the switch; and when the first door and the second door are closed, the second door presses the pusher, which in turn presses the switch to supply electricity to the image forming unit.

2. The image forming apparatus of claim 1, wherein the switch comprises a microswitch;

when a lever of the microswitch is pressed by the pusher, electricity to the image forming unit is supplied; and when the lever of the microswitch is not pressed by the pusher, the lever is released and electricity to the image forming apparatus is suspended.

3. The image forming apparatus of claim 1, wherein the pusher is hinged to the end of the first door, and is a substantially L-shaped element which includes a projection to press the switch.

4. The image forming apparatus of claim 1, wherein the pusher is biased away from the switch.

5. The image forming apparatus of claim 1, wherein the first door locking means includes a locking projection formed on the second door, and a locking groove formed on a bracket of the first door to mate with the locking projection.

6. An image forming apparatus comprising:

a case including a first door and a second door;

an image forming unit arranged inside the case;

first door locking means to prevent the first door from being opened when the second door is closed; and a microswitch having a lever, when the lever is pressed by a pusher, electricity to the image forming unit is supplied, and when the lever of the microswitch is not pressed by the pusher, the lever is released and electricity to the image forming apparatus is suspended;

wherein the first door includes the pusher to press the switch, and when the first door and the second door are closed, the second door presses the pusher, which in turn presses the switch to supply electricity to the image forming unit.

7. The image forming apparatus of claim 6, wherein the pusher is hinged to the end of the first door, and is a substantially L-shaped element which includes a projection to press the switch.

8. The image forming apparatus of claim 6, wherein the pusher is biased away from the switch.

9. The image forming apparatus of claim 6, wherein the first door locking means includes a locking projection formed on the second door, and a locking groove formed on a bracket of the first door to mate with the locking projection.

10. An image forming apparatus comprising:

a case including a first door and a second door, the first door includes locking means;

an image forming unit arranged inside the case; and a switch to supply or suspend electricity to the image forming unit, wherein the first door includes a pusher to press the switch, and when the first door and the second door are closed, the second door presses the pusher, which in turn presses the switch to supply electricity to the image forming unit.

11. The image forming apparatus of claim 10, wherein the switch comprises a microswitch, when a lever of the microswitch is pressed by the pusher, electricity to the image forming unit is supplied, and when the lever of the microswitch is not pressed by the pusher, the lever is released and electricity to the image forming apparatus is suspended.

12. The image forming apparatus of claim 10, wherein the pusher is hinged to the end of the first door, and is a substantially L-shaped element which includes a projection to press the switch.

13. The image forming apparatus of claim 10, wherein the pusher is biased away from the switch.

14. The image forming apparatus of claim 10, wherein the first door locking means includes a locking projection formed on the second door, and a locking groove formed on a bracket of the first door to mate with the locking projection.

15. An image forming apparatus comprising:

a case including a first door and a second door, the second door having a projection;

an image forming unit arranged inside the case;

a switch to supply and suspend electricity to the image forming unit;

a first door locking unit to prevent the first door from being opened when the second door is closed; and a pusher, hingedly connected to the first door and biased away from the switch;

wherein when the first door and the second door are closed, the projection presses the pusher, which in turn presses the switch to supply electricity to the image forming unit.

* * * * *